US005099576A

United States Patent [19]

Shinmura

[11] Patent Number: 5,099,576

[45] Date of Patent: Mar. 31, 1992

[54] HEAT EXCHANGER AND METHOD FOR MANUFACTURING THE HEAT EXCHANGER

[75] Inventor: Toshiharu Shinmura, Gunma, Japan

[73] Assignee: Sanden Corporation, Gunma, Japan

[21] Appl. No.: 574,049

[22] Filed: Aug. 29, 1990

[30] Foreign Application Priority Data

| | | | |
|---|---|---|---|
| Aug. 29, 1989 | [JP] | Japan | 1-99869[U] |
| Sep. 6, 1989 | [JP] | Japan | 1-229127 |
| Sep. 14, 1989 | [JP] | Japan | 1-239510 |

[51] Int. Cl.[5] ..... B21D 31/06

[52] U.S. Cl. ..... 29/890.049; 29/890.053; 165/153; 165/173

[58] Field of Search ..... 165/152, 153, 173; 29/890.49, 890.53

[56] References Cited

U.S. PATENT DOCUMENTS

| | | | |
|---|---|---|---|
| 4,031,745 | 6/1977 | McCarty | 72/367 |
| 4,527,411 | 7/1985 | Shinosaki et al. | 72/340 |
| 4,558,695 | 12/1985 | Kumazawa et al. | 228/183 |
| 4,580,324 | 4/1986 | Laska | 72/325 X |

FOREIGN PATENT DOCUMENTS

| | | | |
|---|---|---|---|
| 124110 | 5/1947 | Australia | 165/153 |
| 219974 | 9/1986 | European Pat. Off. . | |
| 527341 | 6/1931 | Fed. Rep. of Germany | 165/153 |
| 59-52196 | 3/1984 | Japan | 29/890.049 |
| 61-67530 | 4/1986 | Japan | 29/890.049 |
| 251602 | 8/1948 | Switzerland | 165/153 |
| 47923 | 3/1911 | United Kingdom | 165/153 |
| 580652 | 9/1946 | United Kingdom | 165/153 |

*Primary Examiner*—Allen J. Flanigan

*Attorney, Agent, or Firm*—Banner, Birch, McKie & Beckett

[57] ABSTRACT

A heat exchanger includes a pair of header pipes having connection holes, and flat tubes disposed between the header pipes and connected to the header pipes at their end portions. Each of the flat tubes has connecting portions at its end portions which are inserted into the connection holes. The connecting portions have a flow area substantially equal to the flow area of the central portion of the flat tube, and have a width smaller than the width of the central portion of the flat tube in the longitudinal direction of the cross section of the central portion of the flat tube. The connection holes may be small in the diameter direction of the header pipes; thus the diameter of the header pipes can be decreased. As a result, the amount of the used heat medium can be reduced. The flat tubes are easily assembled to a desired position merely by inserting the connecting portions into the connection holes.

12 Claims, 8 Drawing Sheets

HEAT EXCHANGER AND METHOD FOR MANUFACTURING THE HEAT EXCHANGER

BACKGROUND OF THE INVENTION

1. Field of the Invention

The present invention relates to a heat exchanger for use as a condenser and a radiator of an air conditioner for a vehicle etc., and methods for manufacturing the heat exchanger.

2. Description of the Prior Art

FIGS. 17-22 show a typical conventional heat exchanger which requires the heat exchange between a heat medium (for example, cooling medium) flowing in the heat exchanger and air passing through the heat exchanger. A heat exchanger 1 shown in FIG. 17 comprises a pair of header pipes 2 extending in parallel relation to each other, a plurality of heat-transfer tubes 3 disposed between the header pipes and connected to the header pipes at their end portions, a plurality of radiation fins 4 provided on the sides of the heat-transfer tubes, and a pair of reinforcement members 5 disposed on the top and bottom radiation fins. An inlet tube 6 for introducing the heat medium into heat exchanger 1 is connected to one of header pipes 2, and an outlet tube 7 for delivering the heat medium out from heat exchanger 1 is connected to the other header pipe.

Heat-transfer tube 3 is formed as a straight flat tube, which is flattened in the horizontal direction, as shown in FIGS. 18 and 20. A wave-shaped plate 9 is provided in the flat tube 3 to form a plurality of flow paths in the flat tube, as shown in FIGS. 20 and 21. Alternatively, the plurality of flow paths may be formed by partitions 10 as shown in FIG. 23. To support flat tubes 3, connection holes 8 are formed on the surfaces of header pipes 2 with a predetermined pitch such that the respective holes extend in the same direction as the flattened direction of flat tubes 3. The end portions of each flat tube 3 are inserted into the corresponding connection holes 8, and fixed to header pipes 2.

However, since header pipe 2 of heat exchanger 1 (FIG. 17) has connection holes 8 extending in the direction perpendicular to the axis of the header pipe and into which flat tubes 3 having a uniform-sized cross section are inserted, the pipe for constituting the header pipe must have a diameter greater than the width of flat tubes 3 in the longitudinal direction of the cross section of the flat tubes. Therefore, the content volume of header pipes 2, which does not directly contribute to the heat exchange, becomes large, and thereby increases the amount of the used heat medium.

Moreover, when the end portions of flat tubes 3 are inserted into connection holes 8 of header pipes 2 and the flat tubes are positioned relative to the header pipes in the assembly of the heat exchanger, it takes a fairly long time to make the lengths of the end portions of the flat tubes inserted into the connection holes uniform, and assembly is not easy.

Further, the wave-shaped plate 9 having the same length as that of flat tube 3 is inserted into the flat tube. The portions of the wave-shaped plate that contact with or approach the inside surface of the flat tube are welded onto the inside surface of the flat tube by, for example, brazing in the step of making the flat tube 3 with wave-shaped plate 9 therein (for example, the method disclosed in unexamined Japanese Patent Publication SHO 62-175588). However, it is difficult to uniformly weld the relatively long wave-shaped plate 9 in the flat tube 3. If wave-shaped plate 9 is not formed as a desired shape which is adapted to the inside form of flat tube 3, a plurality of flow paths separated from one another cannot be formed. This failure makes it difficult to increase the efficiency of the heat exchange by uniformly diverging the flow of the heat medium into a plurality of flow paths and passing the heat medium uniformly through flow paths which are separated from one another. Furthermore, since wave-shaped plate 9 must be preformed so that it is adapted to the inside of flat tube 3 before it is inserted, the processing and preforming of the wave-shaped plate is a troublesome operation.

SUMMARY OF THE INVENTION

Accordingly, an object of the present invention is to provide a heat exchanger which can lessen the diameter of header pipes without decreasing the heat transfer area of the heat exchanger, and thereby reduce the amount of used heat medium.

Another object of the present invention is to provide a heat exchanger wherein, in the assembly of the heat exchanger, flat tubes can be positioned without adjusting the lengths of the end portions of the flat tubes inserted into connection holes of header pipes, and thereby facilitate an easy assembly.

A further object of the present invention is to provide a method for easily manufacturing flat tubes for a heat exchanger, each of which has a plurality of flow paths therein separated from one another.

To achieve these objects, a heat exchanger according to the present invention is herein provided. The heat exchanger comprises a pair of substantially parallel header pipes each having a plurality of connection holes and a plurality of substantially parallel flat tubes disposed between the pair of header pipes. The flat tubes are connected to the pair of header pipes at their end portions by inserting their end portions into the connection holes. Each of the flat tubes has connecting portions at its end portions which are inserted into the connection holes. The connecting portions have a flow area substantially equal to the flow area of the central portion of the flat tube, but have a width smaller than the width of the central portion of the flat tube in the longitudinal direction of the cross section of the central portion of the flat tube.

A method for manufacturing heat exchanger tubes according to the present invention is also provided. The heat exchanger tubes are disposed between a pair of header pipes and connected to the pair of header pipes at their end portions. The method comprises the steps of inserting a wave-shaped plate into a pipe, wherein the wave-shaped plate is shorter than the pipe; pressing the pipe at its central portion, other than its end portions where the wave-shaped plate does not exist, to form the central portion as a shape of a flat tube and hold the wave-shaped plate by the inner surface of the pressed central portion; and pressing the end portions of the pipe in a direction crossing relative to the direction of the pressing of the central portion to form the end portions as connecting portions to be connected to the pair of header pipes.

Further, another method for manufacturing heat exchanger tubes according to the present invention is provided. The method comprises the steps of pressing one of the end portions of a pipe to form the end portion as a connecting portion to be connected to one of the pair of header pipes; inserting a wave-shaped plate into the pipe from the other end portion of the pipe, wherein the wave-shaped plate is shorter than the pipe; pressing the pipe at its central portion, other than its end portions where the wave-shaped plate does not exist, in a direction crossing relative to the direction of the pressing of the one end portion of the pipe, to form the central portion as a shape of a flat tube and hold the wave-shaped plate by the inner surface of the pressed central portion; and pressing the other end portion of the pipe in the same direction as the direction of the pressing of the one end portion of the pipe to form the other end portion as a connecting portion to be connected to the other of the pair of header pipes.

Furthermore, a method for manufacturing a heat exchanger according to the present invention is provided. The method comprises the steps of pressing the end portions of each of the flat tubes in the longitudinal direction of the cross section of the flat tube, forming the connection holes on the header pipes as a shape corresponding to the shape of the pressed end portions, and inserting the pressed end portions into corresponding connection holes.

In the heat exchanger according to the present invention, since the connecting portions of the flat tubes have a width smaller than the width of the central portion of the flat tube in the longitudinal direction of the cross section of the central portion of the flat tube, the width in the same direction of the connection holes of the header pipes, into which the end portions (the connecting portions) are inserted, may be also small. Therefore, the diameter of the header pipes may be smaller than that of the header pipes of the conventional heat exchanger. Moreover, it is even possible to set the diameter of the header pipes to a diameter smaller than the width of the central portion of the flat tube. The amount of used heat medium can be decreased by the small-diameter header pipes. Moreover, since the connecting portions of the flat tubes have a flow area substantially equal to the flow area of the central portion of the flat tube, the heat medium can smoothly flow through the flat tube.

Further, since a stepped portion is formed between each connecting portion and the corresponding central portion of the flat tube, the length of the end portion of the flat tube, which is to be inserted into the connection hole of the header pipe, is automatically adjusted to a desired length substantially without any adjusting operation. Therefore, assembly of the heat exchanger is easy.

Such a heat exchanger can be manufactured by the method for manufacturing a heat exchanger according to the present invention.

In the method for manufacturing heat exchanger tubes according to the present invention, the wave-shaped plate is shorter than the pipe and can be brought into contact with the inside surface of the flat tube formed from the pipe and held by the inside surface by pressing the pipe along its central portion. This assembly process permits a plurality of flow paths, separated from one another, to be formed in the flat tube easily and precisely. Moreover, since the end portions of the pipe are pressed in a direction transverse to the direction of the pressing of the central portion of the pipe, to form the end portions as connecting portions to be connected to the pair of header pipes, the wave-shaped plate is more surely fixed in the pipe (flat tube) at a desired position by the pressed and deformed end portions located on both sides of the wave-shaped plate.

BRIEF DESCRIPTION OF THE DRAWINGS

Some preferred exemplary embodiments of the invention will now be described with reference to the accompanying drawings, which are given by way of example only, and are not intended to limit the present invention.

DETAILED DESCRIPTION OF PREFERRED EMBODIMENTS OF THE INVENTION

Figure 1:
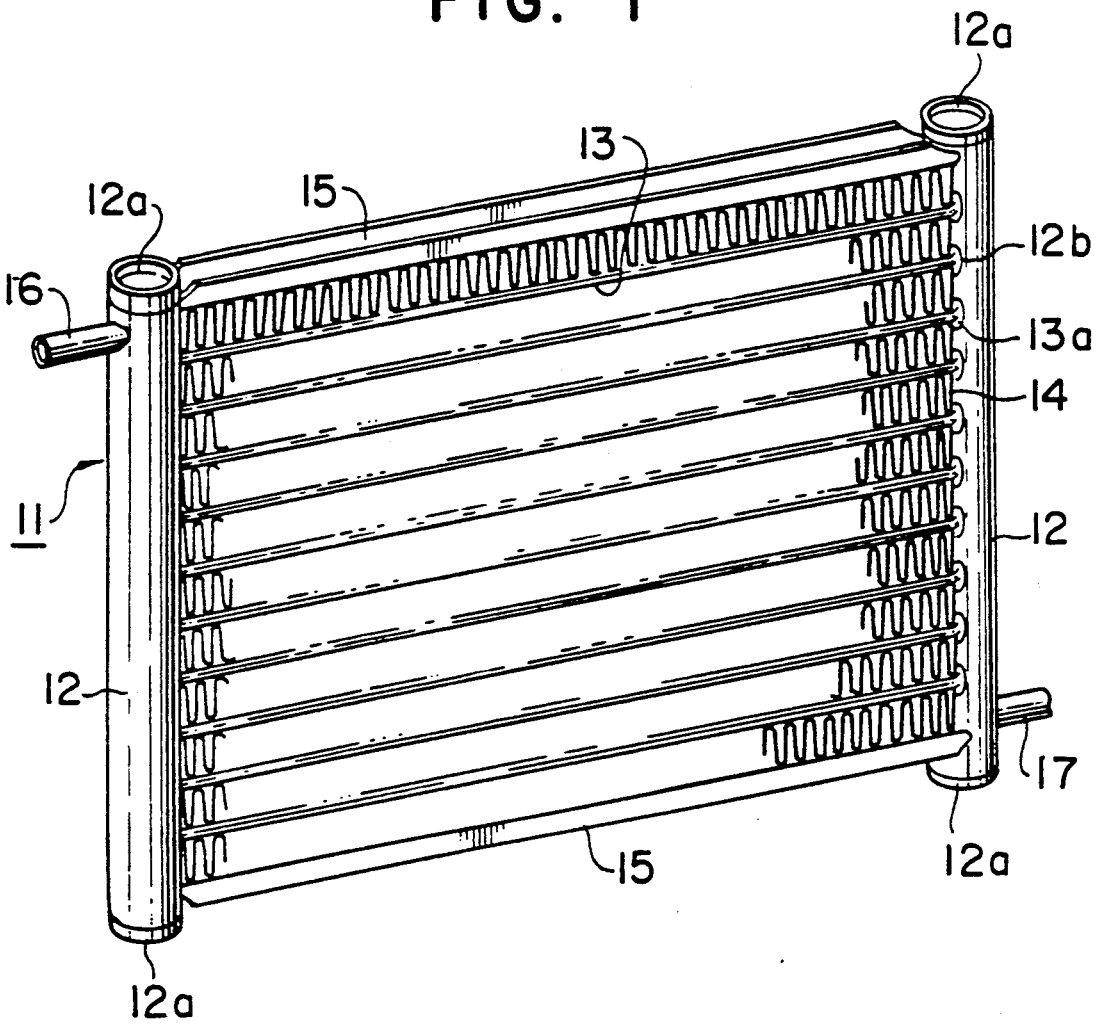
FIG. 1 is a perspective view of a heat exchanger according to a first embodiment of the present invention.

Referring to the drawings, FIGS. 1 to 6 illustrate a heat exchanger according to a first embodiment of the present invention. In FIG. 1, a heat exchanger 11 has a pair of header pipes 12 extending in parallel relation to each other. Header pipes 12 are closed at both of their end portions by caps 12*a*. A plurality of substantially parallel flat tubes 13 are disposed between the pair of header pipes 12. The flat tubes 13 are connected to the pair of header pipes 12 at their end portions. A plurality of corrugate type radiation fins 14 are provided on the sides of flat tubes 13 and fixed to the flat tubes by, for example, brazing. Reinforcement members 15 are provided on the upper surface of the top radiation fin 14 and the lower surface of the bottom radiation fin 14, respectively, and fixed to the upper and the lower surfaces of the respective radiation fins and the sides of header pipes 12. An inlet tube 16 is connected to the upper portion of one of header pipes 12, and an outlet tube 17 is connected to the lower portion of the other header pipe. A heat medium (cooling medium) is introduced from inlet tube 16, flows through header pipes 12 and flat tubes 13, and flows out from outlet tube 17.

Figure 2:
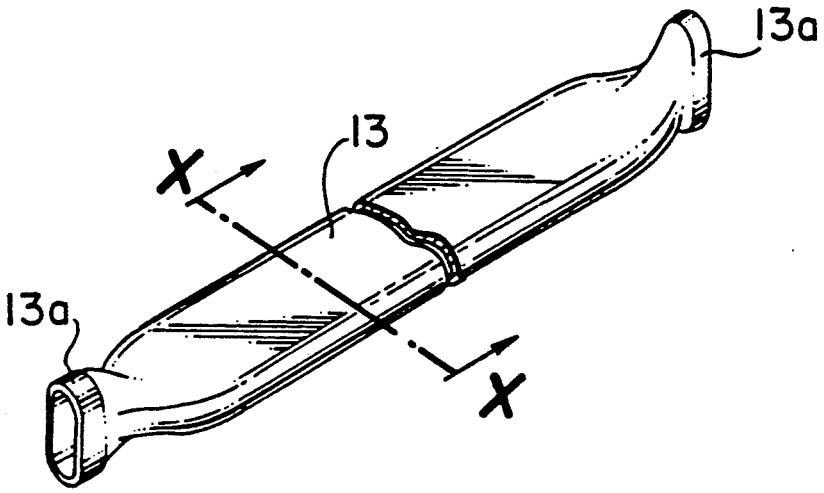
FIG. 2 is an enlarged perspective view of the flat tube of the heat exchanger shown in FIG. 1.
Figure 3:
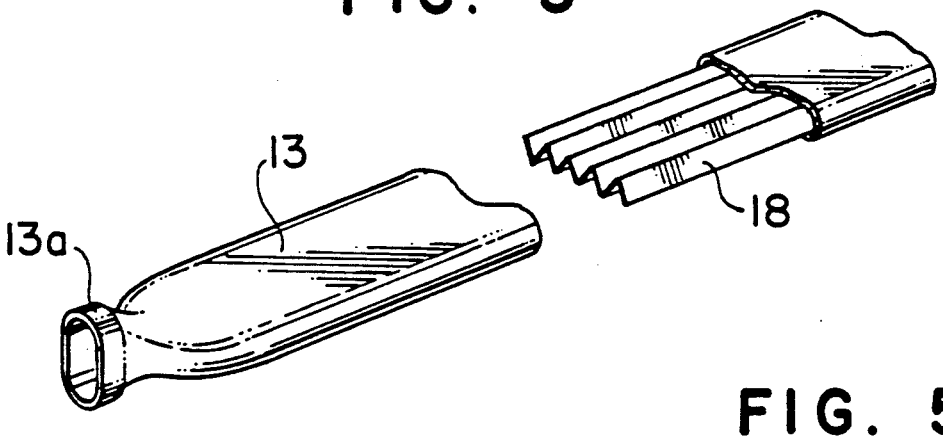
FIG. 3 is an exploded perspective view of the flat tube shown in FIG. 2.
Figure 5:
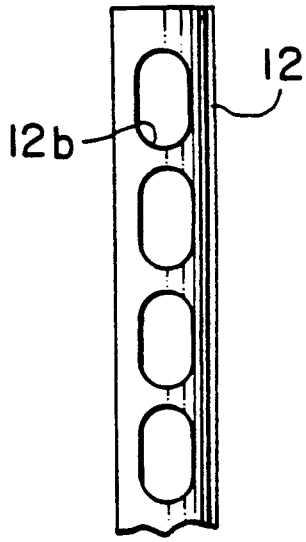
FIG. 5 is a partial side view of the header pipe of the heat exchanger shown in FIG. 1.
Figure 4:
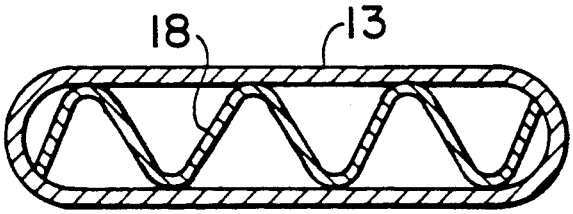
FIG. 4 is an enlarged cross sectional view of the flat tube shown in FIG. 2, taken along X—X line of FIG. 2.
Figure 6:
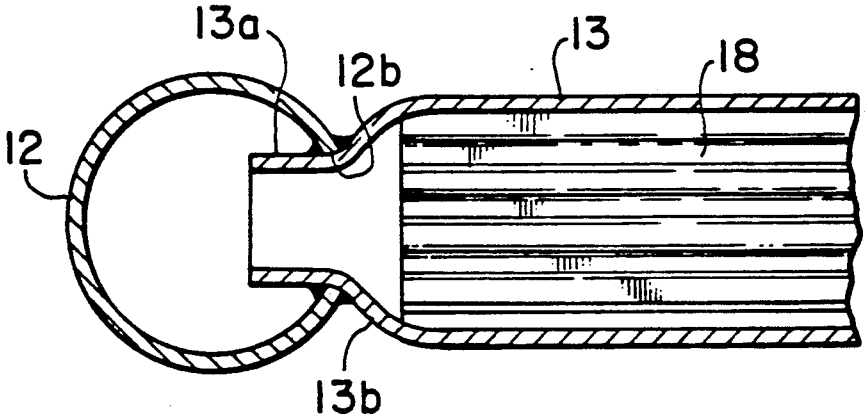
FIG. 6 is an enlarged cross sectional view of the connection portion of the flat tube and the header pipe of the heat exchanger shown in FIG. 1.

Each flat tube 13 is formed as illustrated in FIGS. 2 to 4. Flat tube 13 has a wave-shaped plate 18 therein. Wave-shaped plate 18 is shorter than the length of flat tube 13 in the longitudinal direction of the flat tube. Wave-shaped plate 18 partitions the inside space of flat tube 13, and divides the inside space into a plurality of flow paths. Therefore, wave-shaped plate 18 constitutes a rectifying means for the flow of the heat medium flowing through flat tube 13 in this embodiment. Flat tube 13 is flattened in the horizontal direction along its central portion. The wave-shaped plate 18 exists in this flattened central portion The end portions of flat tube 13 are formed as connecting portions 13*a* to be connected to the respective header pipes 12 and to be inserted into connection holes 12*b* formed on the sides of the respective header pipes (FIG. 5). Each connecting portion 13*a* is flattened to extend in the direction perpendicular to the longitudinal direction of the cross section of the central portion of flat tube 13. In this embodiment, connecting portion 13*a* is formed as an oval or an ellipse in cross section. Connecting portion 13*a* has a flow area substantially equal to the flow area of the central portion of flat tube 13, and has a width smaller than the width of the central portion of the flat tube in the longitudinal direction of the cross section of the central portion of the flat tube.

On the side surface of each header pipe 12, a plurality of connection holes 12*b* are defined at a predetermined pitch. Each connection hole 12*b* is formed as substantially the same shape as the outer shape of the cross section of the corresponding connecting portion 13*a* of flat tube 13. The respective connecting portions 13*a* are inserted into the corresponding connection holes 12*b*, and fixed to header pipes 12 by, for example, brazing. Thus, flat tubes 13 are connected to the pair of header pipes 12.

The heat exchanger 11 thus constituted is, for example, mounted on a vehicle as a condenser of an air conditioner. The heat medium (cooling medium) sent from a compressor (not shown) when the air conditioner operates, flows into one of header pipes 12 through inlet tube 16. The heat medium is heat exchanged with air via corrugate type radiation fins 14 when the heat medium passes through flat tubes 13. Thereafter, the heat medium flows out from outlet tube 17 connected to the other header pipe 12.

Since connecting portions 13*a* of flat tubes 13 are formed such that their widths are smaller than the widths of the central flat portions of flat tubes 13 in the direction of the cross sections of the central flat portions, the widths of connection holes 12*b* of header pipes 12 in the same direction may be small. Therefore, the diameter of header pipes 12 may be smaller than those of header pipes in conventional heat exchangers. As a result, the amount of used heat medium and the amount of material for use in manufacturing the heat exchanger can be reduced, thereby reducing the cost for the heat medium and the material.

Moreover, since the flow area of connecting portion 13*a* is set to an area substantially equal to the flow area of the central flat portion of flat tube 13, the heat medium can flow smoothly in and through the flat tube over the entire length including both connecting portions 13*a* at the both end portions.

Further, a stepped portion 13*b* (FIG. 6) is formed between connecting portion 13*a* and the central flat portion in each end portion of each flat tube 13. When the end portion of flat tube 13 is inserted into the corresponding connection hole 12*b* of header pipe 12, the flat tube is naturally regulated in its insertion length by the stepped portion. The flat tube is automatically set to a desired position relative to the header pipe merely by inserting its end portion into the connection hole until the insertion is stopped. Therefore, the adjusting operation such as one required in the conventional heat exchangers is not required, and assembly of the heat exchanger according to the present invention is very easy.

Furthermore, in the embodiment, since the heat medium that flows into flat tube 13 is uniformly diverged into a plurality of flow paths separated from one another by wave-shaped rectifying plate 18, the efficiency of the heat exchange of the heat exchanger can be greatly increased.

Such flat tubes 13 are manufactured as shown in FIGS. 7A to 7F.

Figure 7A:
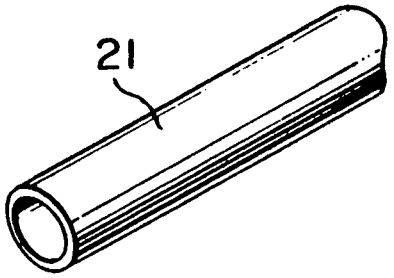
FIGS. 7A to 7F are perspective views of a pipe and rollers, showing a method for manufacturing a flat tube according to an embodiment of the present invention.
Figure 7B:
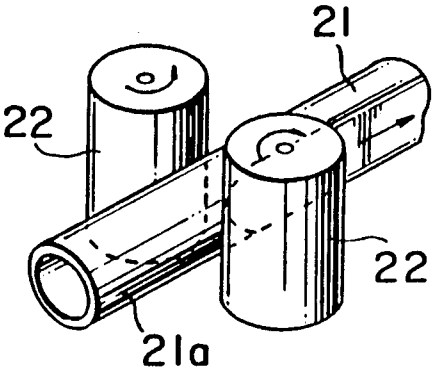
Figure 7C:
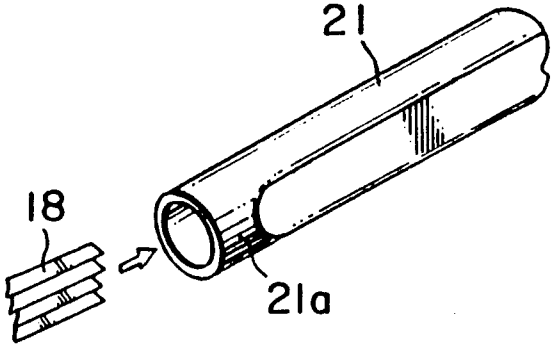

Firstly, a pipe 21 having a circular cross section and a predetermined length is prepared as shown in FIG. 7A. Next, pipe 21 is pressed to some extent from both outer sides by a pair of rollers 22 to slightly flatten the central portion other than the end portions 21*a*, as shown in FIG. 7B. The shape of the cross section of the end portions 21*a* remains as it was. Thereafter, wave-shaped plate 18 is inserted into the pipe 21 from one end portion 21*a* to be located at a predetermined position in the pipe, as shown in FIG. 7C. The wave-shaped plate 18 is formed shorter than the pipe 21 by the length corresponding to the length of the non-pressed end portions 21*a*. In the state where wave-shaped plate 18 is inserted into the pipe 21 at the predetermined position, the wave-shaped plate does not exist in end portions 21*a*.

Figure 7D:
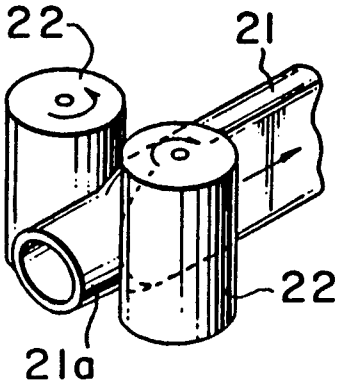

Next, the slightly pressed pipe 21 is further pressed by the pair of rollers 22 in the same direction as the above prepressing direction such that wave-shaped plate 18 is completely brought into contact with the inner surface of the pipe and slightly deformed, as shown in FIG. 7D. By this pressing, the crests of wave-shaped plate 18 are substantially completely brought into contact with the inner surface of flattened pipe 21, and held by the inner surface.

Figure 7E:
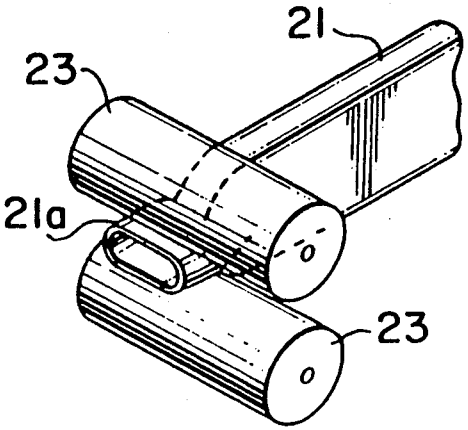

Thereafter, end portions 21*a*, which have been non-deformed, are pressed by a pair of rollers 23 in a direction crossing relative to the direction of the pressing by the pair of rollers 22 to form the end portions 21*a* as connecting portions 13*a*, as shown in FIG. 7E. In this embodiment, the pressing direction by the pair of rollers 23 is perpendicular to the pressing direction by the pair of rollers 22. By this pressing, the ends of wave-shaped plate 18 are fixed in the axial direction of the pipe.

Figure 7F:
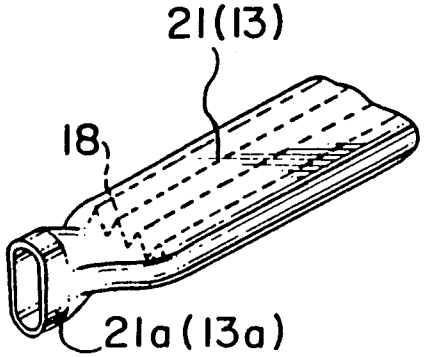

Thus, the pipe 18 is formed as flat tube 13 having wave-shaped plate 18 therein and connecting portions 13*a* at its end portions, as shown in FIG. 7F.

In the method for manufacturing the heat exchanger tubes, the wave-shaped plate 18 are each held by the inner surface of flat tube 13 in the state that the crests of the wave-shaped plate 18 are substantially completely brought into contact with the inner surface of the flat tube 13. This construction permits a plurality of flow paths to be surely and easily formed in the tube, so that the plurality of flow paths can be surely separated from one another.

Moreover, since wave-shaped plate 18 is fixed at its both end portions by connecting portions 13*a* as well as held by the inner surface of flat tube 13, the wave-shaped plate 18 is more completely fixed at a desired position.

Although the end potions of pipe 21 are pressed after wave-shaped plate 18 is held and fixed in the flattened portion of the pipe in the above embodiment, another method can be used. Namely, one of the end portions of a pipe is first pressed to form the end portion as a connecting portion. Secondly, a wave-shaped plate is inserted into the pipe from the other end portion. Thirdly, the central portion of the pipe is pressed to flatten the central portion and hold the wave-shaped plate therein. Finally, the other end portion is pressed to form the other end portion as another connecting portion.

Figure 8:
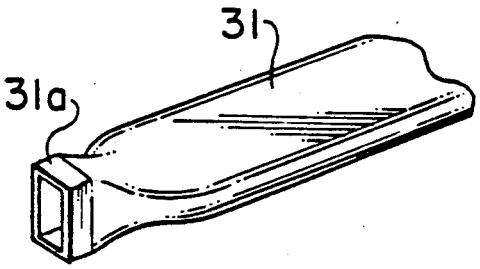
FIG. 8 is a partial perspective view of a flat tube of a heat exchanger according to a second embodiment of the present invention.
Figure 9:
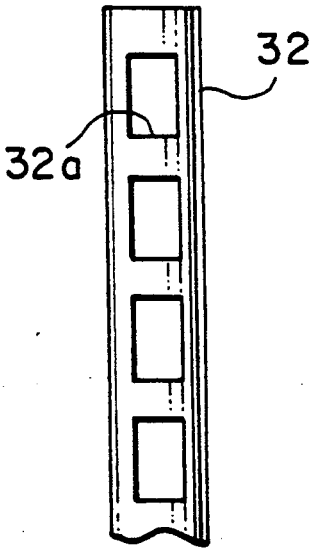
FIG. 9 is a partial side view of a header pipe of the heat exchanger according to the second embodiment.

FIGS. 8 and 9 illustrate a flat tube and a header pipe of a heat exchanger according to a second embodiment of the present invention. In this embodiment, connecting portions 31*a* of a flat tube 31 are formed as a rectangle in cross section. The width of the rectangle is smaller than the width of the central portion of flat tube 31 in the longitudinal direction of the cross section of the central portion. Connection holes 32*a* of a header pipe 32 are formed as a shape corresponding to the rectanglar shape of connecting portions 31*a*. Connecting portions 31*a* are inserted into connection holes 32*a* for assembly of the heat exchanger.

Figure 10:
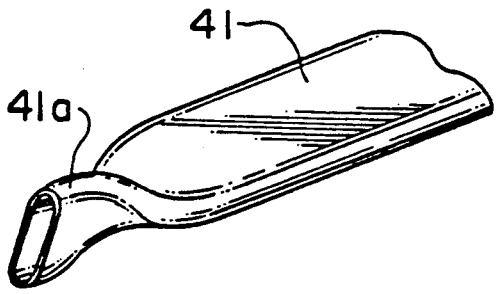
FIG. 10 is a partial perspective view of a flat tube of a heat exchanger according to a third embodiment of the present invention.
Figure 11:
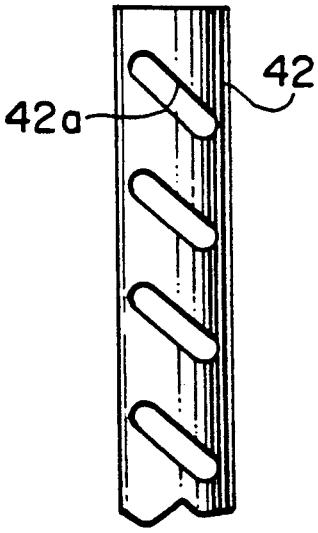
FIG. 11 is a partial side view of a header pipe of the heat exchanger according to the third embodiment.
Figure 12:
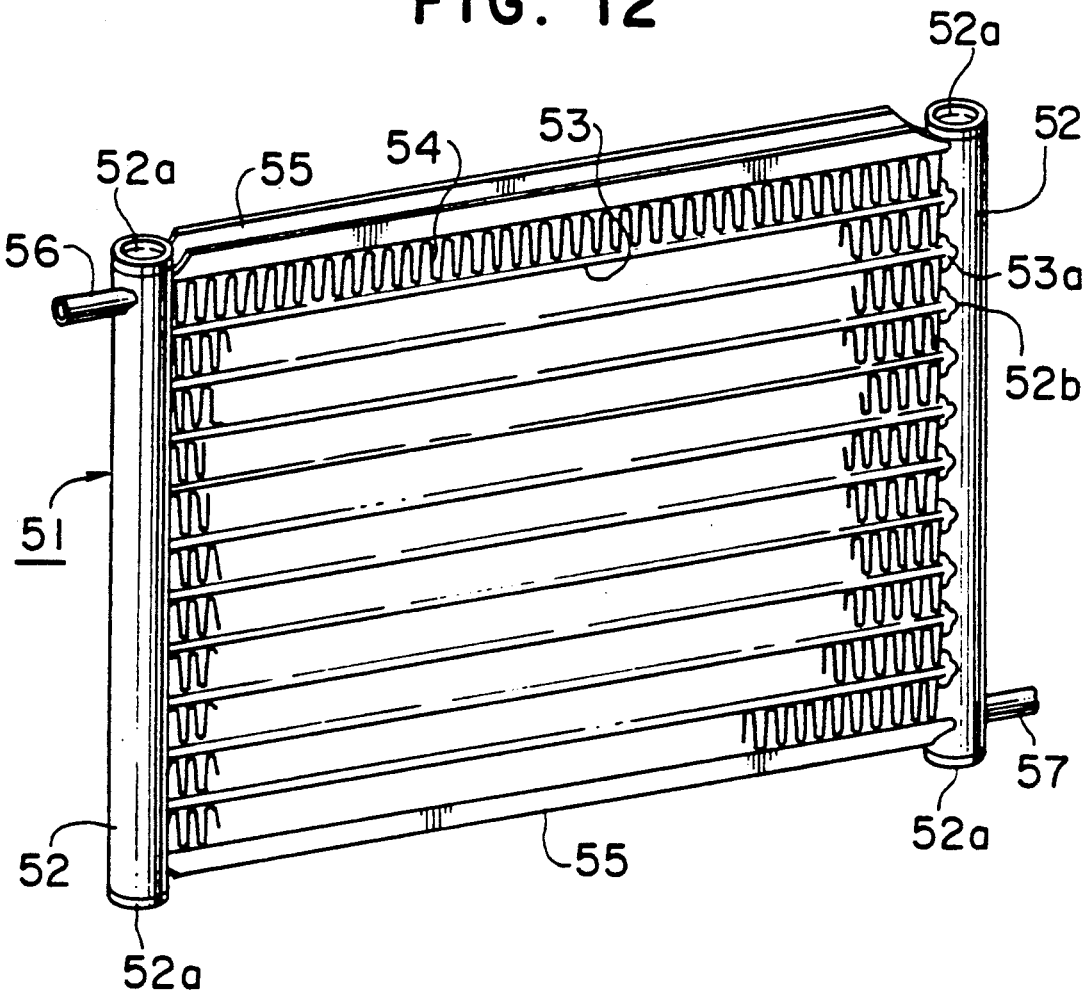
FIG. 12 is a perspective view of a heat exchanger according to a fourth embodiment of the present invention.

FIGS. 10 and 11 illustrate a flat tube and a header pipe of a heat exchanger according to a third embodiment of the present invention. In this embodiment, each of the connecting portions 41*a* of a flat tube 41 is formed such that its axis extending in the longitudinal direction of its cross section inclines at an angle (for example, 45 degrees) relative to the axis of the central portion of the flat tube extending in the longitudinal direction of the cross section of the central portion. Connection holes 42*a* of a header pipe 42 are formed as a shape corresponding to the shape of connecting portions 41*a* and inclined in the same direction as that of the connecting portions 41*a*. Connecting portions 41*a* are inserted into connection holes 42*a* for assembly of the heat exchanger.

FIGS. 12 to 16 illustrate a heat exchanger 51 according to a fourth embodiment of the present invention. In this embodiment, connecting portions 53*a* of flat tubes 53 are formed as a flower-like or quatrefoil shape in cross section. Connection holes 52*b* of header pipes 52 are also formed as a quatrefoil shape, corresponding to the shape of connecting portions 53*a*. Caps 52*a* for header pipes 52, a plurality of corrugate type radiation fins 54, reinforcement members 55, an inlet tube 56 and an outlet tube 57 are substantially the same as those in the first embodiment.

Figure 14:
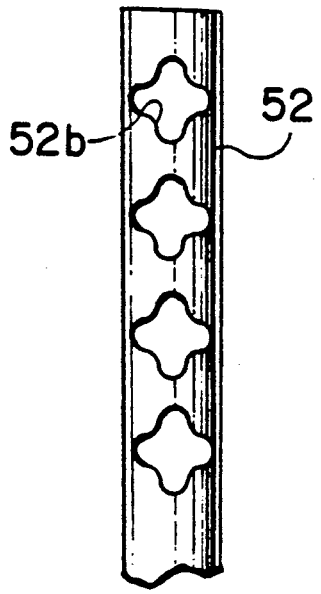
FIG. 14 is a partial side view of the header pipe of the heat exchanger shown in FIG. 12.
Figure 13:
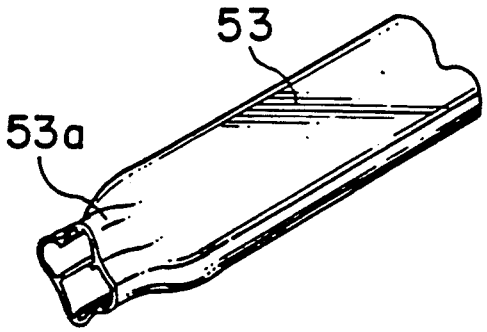
FIG. 13 is an enlarged partial perspective view of the flat tube of the heat exchanger shown in FIG. 12.
Figure 15A:
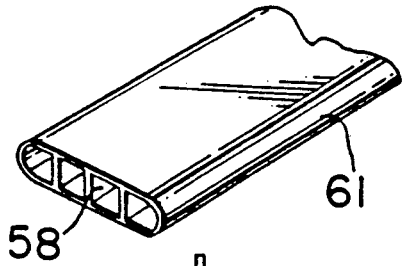
FIGS. 15A to 15D are perspective views of a flat tube, showing a method for manufacturing the flat tube shown in FIG. 12.
Figure 15B:
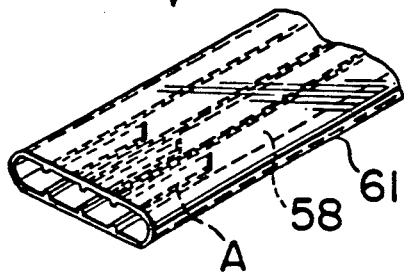
Figure 15C:
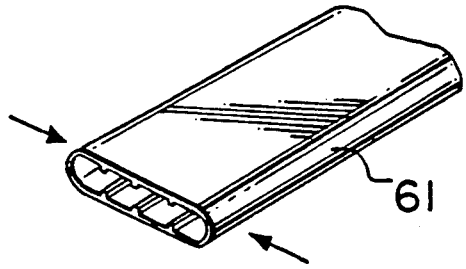
Figure 15D:
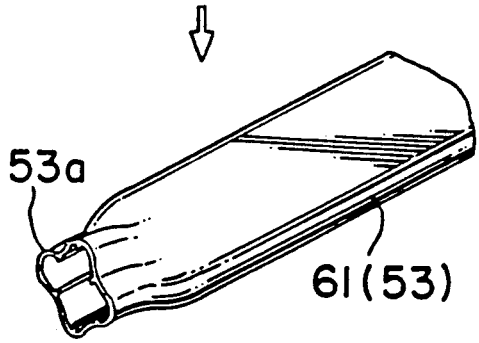
Figure 16:
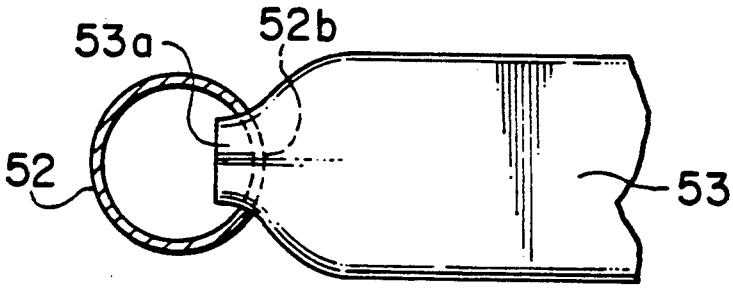
FIG. 16 is an enlarged cross sectional view of the connection portion of the flat tube and the header pipe of the heat exchanger shown in FIG. 12.
Figure 17:
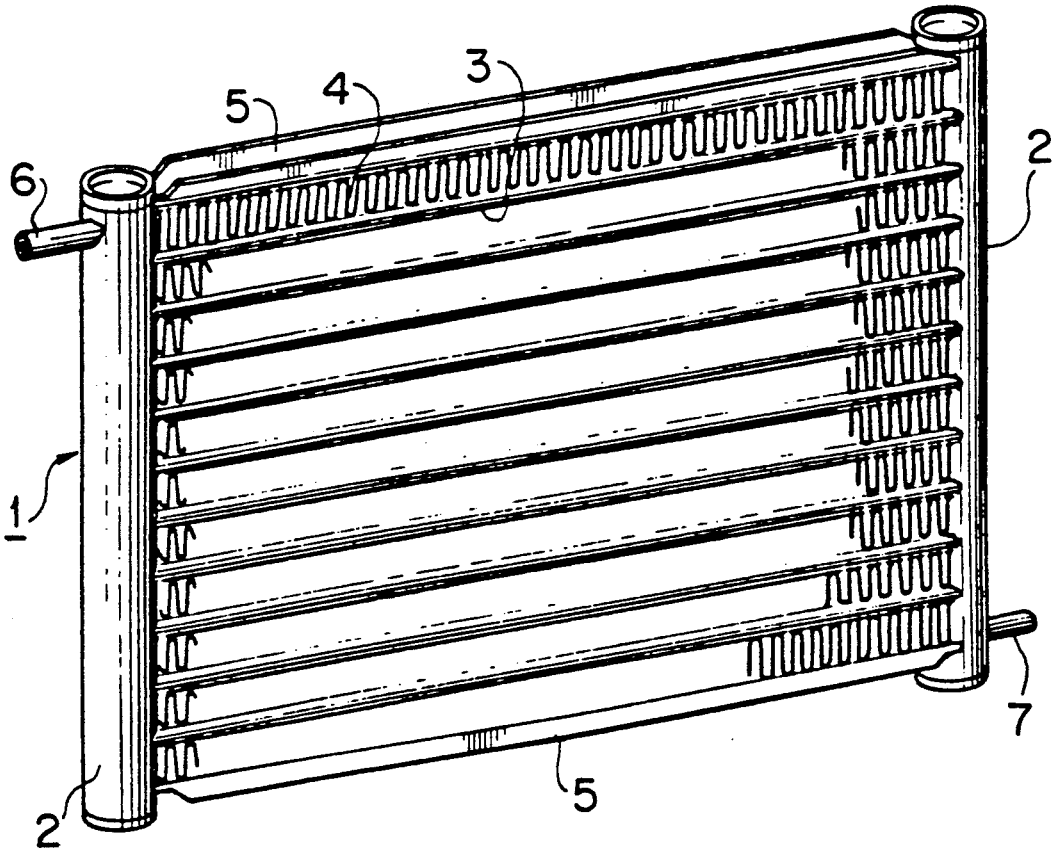
FIG. 17 PRIOR ART
FIG. 17 is a perspective view of a conventional heat exchanger.
Figure 19:
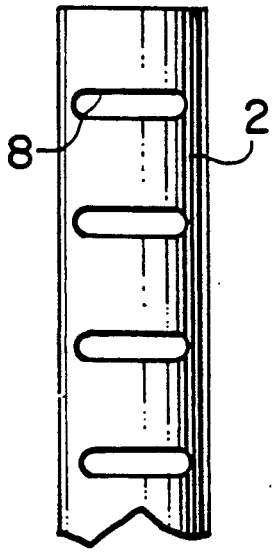
FIG. 19 PRIOR ART
FIG. 19 is a partial side view of the header pipe of the heat exchanger shown in FIG. 17.
Figure 18:
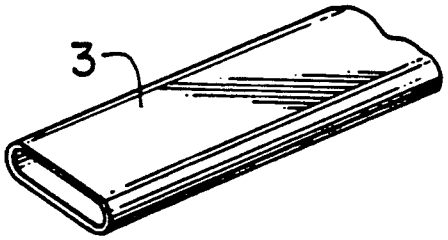
FIG. 18 PRIOR ART
FIG. 18 is an enlarged partial perspective view of the flat tube of the heat exchanger shown in FIG. 17.
Figure 20:
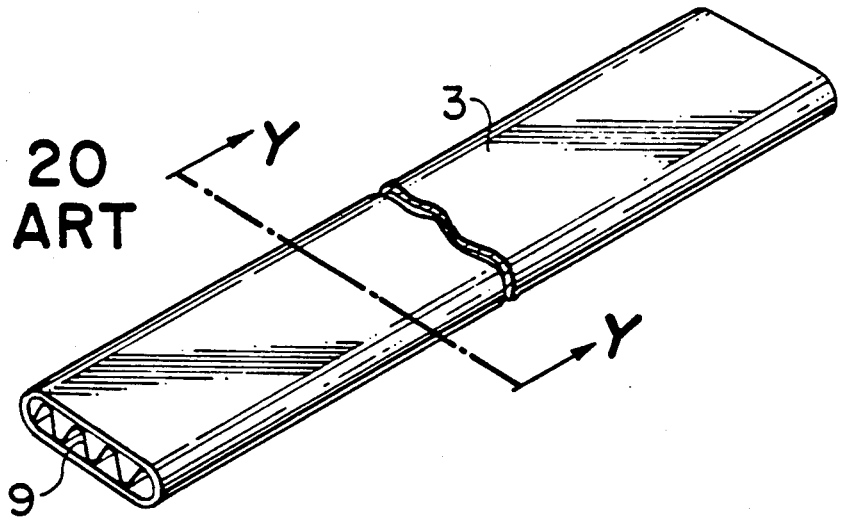
FIG. 20 PRIOR ART
FIG. 20 is an enlarged perspective view of the flat tube of the heat exchanger shown in FIG. 17.
Figure 21:
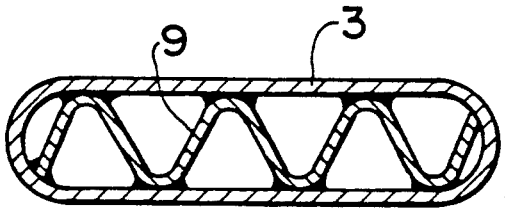
FIG. 21 PRIOR ART
FIG. 21 is an enlarged cross sectional view of the flat tube shown in FIG. 20, taken along Y—Y line of FIG. 20.
Figure 22:
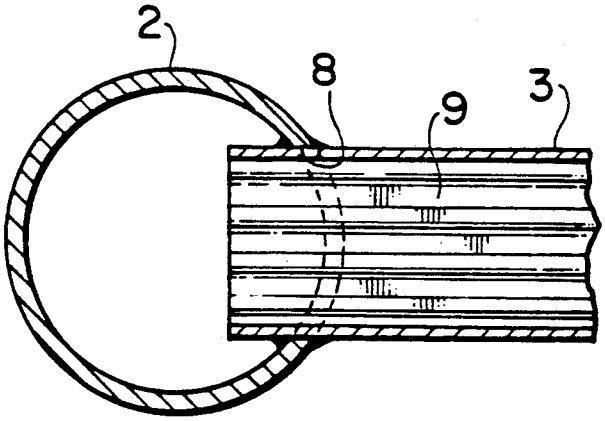
FIG. 22 PRIOR ART
FIG. 22 is an enlarged cross sectional view of the connection portion of the flat tube and the header pipe of the heat exchanger shown in FIG. 17.
Figure 23:
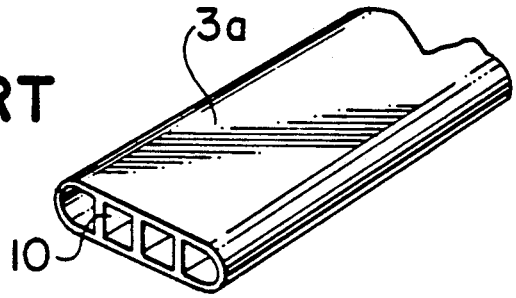
FIG. 23 PRIOR ART
FIG. 23 is a partial perspective view of a flat tube of another conventional heat exchanger.

In this embodiment, flat tubes 53 are formed as shown in FIGS. 15A to 15D. A straight flat tube 6 having a constant-size cross section is prepared. Flat tube 61 has a plurality of partitions 58 dividing the inside space of the flat tube into a plurality of flow paths as shown in FIG. 15A. The end portions of the plurality of partitions 58 are cut away to a predetermined length in the longitudinal direction of flat tube 61, as shown by cut away portions (A) in FIG. 15B. Thereafter, the end portion of flat tube 61 is pressed from both outsides in the longitudinal direction of the cross section of the end portion, as shown in FIG. 15C. By this pressing, the width of the end portion of flat tube 61 decreases and the central portions of the upper and lower walls of the end portion protrude outwards, as shown in FIG. 15D. The pressing is carried out until the width and height of the deformed end portion of flat tube 61 become substantially the same. Thus, the connecting portions 53*a* having the cross section, which is formed as a quatrefoil shape, is made. Connection holes 52*b* are formed corresponding to the shape of connecting portions 53*a*, i.e., as the same quatrefoil shape, as shown in FIG. 14. The connecting portions 53*a* are inserted into the connection holes 52*b* until the flat tubes 52 are stopped by the stepped portions formed between the respective central portions and the respective connecting portions of the flat tubes.

The length of the end portions to be formed as connecting portions is easily changed by determining the length of the cut away portions of the partitions, as needed. The shape of the connecting portions to be formed at the end portions of the flat tubes also can be changed to various shapes, as needed.

Although the pipe 61 having partitions 58 therein is used for manufacturing the flat tube 53 in the embodiment, it is possible to use a pipe which does not have partitions therein, to form a flat tube having connecting portions at its end portions which are deformed as a quatrefoil shape having a width smaller than the width of the non-deformed central portion of the flat tube and having substantially the same flow area as that of the central portion.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of the invention as defined by the following claims.

I claim:

1. A method for manufacturing heat exchanger tubes disposed between a pair of header pipes and connected to said pair of header pipes at their end portions, the method comprising the steps of:

inserting a wave-shaped plate into a pipe, said wave-shaped plate being shorter than said pipe;

pressing said pipe at its central portion, other than its end portions where said wave-shaped plate does not exist, to form said central portion as a shape of a flat tube and hold said wave-shaped plate by the inner surface of the pressed central portion; and pressing said end portions of said pipe in a direction transverse to the direction of said pressing of said central portion to form said end portions as connecting portions to be connected to said pair of header pipes.

2. The method according to claim 1 wherein said central portion and said end portions of said pipe are pressed by respective pairs of rollers.

3. The method according to claim 1 further comprising the step of pressing said pipe at its central portion to deform said central portion to a shape of a slightly flat tube before said inserting step.

4. A method for manufacturing heat exchanger tubes disposed between a pair of header pipes and connected to said pair of header pipes at their end portions, the method comprising the steps of:

pressing one of the end portions of a pipe to form the end portion as a connecting portion to be connected to one of said pair of header pipes;

inserting a wave-shaped plate into said pipe from the other end portion of said pipe, said wave-shaped plate being shorter than said pipe;

pressing said pipe at its central portion, other than its end portions where said wave-shaped plate does not exist, in a direction transverse to the direction of said pressing of said one end portion of said pipe, to form said central portion as a shape of a flat tube and hold said wave-shaped plate by the inner surface of the pressed central portion; and pressing said other end portion of said pipe in the same direction as the direction of said pressing of said one end portion of said pipe to form said other end portion as a connecting portion to be connected to the other of said pair of header pipes.

5. A method for manufacturing a heat exchanger including a pair of substantially parallel header pipes each having a plurality of connection holes and a plurality of substantially parallel flat tubes each having a plurality of end portions and a plurality of partitions therein to form a plurality of flow paths, said flat tubes being disposed between said pair of header pipes and connected to said pair of header pipes at their end portions by inserting their end portions into said connection holes, the method comprising the steps of:

cutting away the longitudinal end portions of said partitions provided in each of said flat tubes before said pressing step;

pressing the end portions of each of said flat tubes in the longitudinal direction of the cross section of the flat tube, forming said connection holes as a shape corresponding to the shape of said pressed end portions, and inserting said pressed end portions into corresponding connection holes.

6. A method for manufacturing a heat exchanger tube defining a central portion and a pair of end portions, the heat exchanger tube being adapted for mounting between a plurality of header pipes at its end portions in the assembly of a heat exchanger, said method comprising:

inserting a rectifying means within the central portion of the tube;

pressing the central portion of the tube in a first direction to cause the central portion to flatten so that its width is greater than its height, said pressing of said central portion being performed in two separate steps including an initial pressing partially flattening the central portion of the tube prior to said insertion of said rectifying means and a final pressing step after said insertion of said rectifying means;

pressing each of the end portions of the tube in a second direction, transverse to the first direction, to cause the end portions to flatten so that their widths are each less than the width defined by the central portion of the tube, said pressing of said end portions being performed such that one of the end portions is pressed prior to said insertion of the rectifying means and the other is pressed after said insertion of said rectifying means, whereby the header pipes mounting the tube in the assembled heat exchanger can have a reduced width which accommodates the width of the end portions of the tube.

7. A method for manufacturing a heat exchanger tube defining a central portion and a pair of end portions, the heat exchanger tube being adapted for mounting between a plurality of header pipes at its end portions in the assembly of a heat exchanger, said method comprising:

inserting a rectifying means within the central portion of the tube;

pressing the central portion of the tube in a first direction to cause the central portion to flatten so that its width is greater than its height;

pressing each of the end portions of the tube in a second direction, transverse to the first direction, to cause the end portions to flatten so that their widths are each less than the width defined by the central portion of the tube, said pressing of said end portions being performed such that one of the end portions is pressed prior to said insertion of the rectifying means and the other is pressed after said insertion of said rectifying means, whereby the header pipes mounting the tube in the assembled heat exchanger can have a reduced width which accommodates the width of the end portions of the tube.

8. A method according to claim 7, wherein said pressing of said central and end portions is performed so that the cross-sectional areas defining flow paths within the central and end portions of the tube are substantially equal.

9. A method of manufacturing a heat exchanger tube having a central portion and end portions, the tube being adapted for positioning between a plurality of header pipes in the fabrication of a heat exchanger, said method comprising:

forming a tube having at least the central portion thereof flattened so that the width is larger than the height;

inserting a rectifying means within the central portion of the tube; and transversely pressing the end portions of the tube so that they each define a width which is less than the width of the central portion of the tube, said pressing of said end portions being performed such that one of said end portions is transversely pressed before the rectifying means is inserted into the tube and the other is pressed after said insertion of the rectifying means.

10. A method according to claim 9, wherein the rectifying means is inserted into the tube before said forming of at least the central portion of the tube.

11. A method of manufacturing a heat exchanger tube for assembly into a heat exchanger, said tube being adapted for connecting between a plurality of header pipes at its end portions, said method comprising:

forming a flat tube having internal partitions which extend axially through the tube, said tube being formed to have a central portion and a pair of end portions and to define a width which is larger than its height;

substantially removing the end portions of the partitions; and forming the end portions of the tube after said removing of said ends of the partitions so that the width of the end portions has a smaller width than the width of the central portion thereof.

12. A method according to claim 11, wherein said forming of the end portions includes forming each of the end portions in a substantially quatrefoil configuration.

* * * * *